US005832766A

United States Patent [19]

Hartman et al.

[11] Patent Number: 5,832,766

[45] Date of Patent: Nov. 10, 1998

[54] SYSTEMS AND METHODS FOR MAKING DECORATIVE SHAPED METAL CANS

[75] Inventors: Mark W. Hartman, Lambertville, N.J.; Zeev W. Shore, Hazel Crest, Ill.; James J. Tang, Palatine, Ill.; Anton A. Aschberger, Downers Grove, Ill.; Michael R. Gogola, Oak Forest, Ill.; William O. Irvine, Golden, Colo.; Ralph J. Trnka, Tinley Park, Ill.; Richard O. Wahler, Palatine, Ill.; Robert A. Winkless, Oak Lawn, Ill.; Richard Mark Orlando Golding, Hinsdale, Ill.; David Harvey, Oxon, Great Britain

[73] Assignee: Crown Cork & Seal Technologies Corporation, Alsip, Ill.

[21] Appl. No.: 683,575

[22] Filed: Jul. 15, 1996

[51] Int. Cl.[6] ..... B21D 26/02

[52] U.S. Cl. ..... 72/62; 72/58

[58] Field of Search ..... 72/58, 59, 61, 72/62, 63

[56] References Cited

U.S. PATENT DOCUMENTS

| | | | |
|---|---|---|---|
| D. 356,501 | 3/1995 | Kornick et al. | D9/518 |
| 2,748,464 | 5/1956 | Kaul | 29/535 |
| 3,029,667 | 4/1962 | Sporck | 80/5 |
| 3,224,239 | 12/1965 | Hansson | 72/62 |
| 3,461,699 | 8/1969 | Roth | 72/56 |
| 3,610,018 | 10/1971 | Swanson et al. | 72/348 |
| 3,757,555 | 9/1973 | Blutt et al. | 72/63 |
| 3,831,416 | 8/1974 | Wolfe | 72/117 |
| 3,896,648 | 7/1975 | Schertenleib | 72/61 |
| 3,911,707 | 10/1975 | Minakov et al. | 72/76 |
| 4,055,064 | 10/1977 | Schow | 72/118 |
| 4,947,667 | 8/1990 | Gunkel et al. | 72/56 |
| 5,058,408 | 10/1991 | Leftault, Jr. et al. | 72/56 |
| 5,187,962 | 2/1993 | Bilko et al. | 72/62 |

(List continued on next page.)

FOREIGN PATENT DOCUMENTS

| | | |
|---|---|---|
| 543 695 | 5/1993 | European Pat. Off. . |
| 0 521 637 B1 | 8/1994 | European Pat. Off. . |
| 1 031 257 | 6/1958 | Germany . |
| 1 925 014 | 11/1970 | Germany . |
| 2 131 811 | 12/1972 | Germany . |
| 23 08 420.0 | 2/1973 | Germany . |
| 3 337 382 A1 | 4/1985 | Germany . |
| 3 716 176 A1 | 9/1988 | Germany . |
| 94 11 461.7 | 9/1994 | Germany . |
| 57-44426 | 3/1982 | Japan . |

(List continued on next page.)

OTHER PUBLICATIONS

Frederic Swing Crispen, C.E. "Dictionary of Technical Terms" Bruce Publishing p. 16 (1946).

*Primary Examiner*—David Jones
*Attorney, Agent, or Firm*—Woodcock Washburn Kurtz Mackiewicz & Norris LLP

[57] ABSTRACT

A method of manufacturing a metallic can body that is shaped distinctively in order to enhance its visual presentation to consumers includes, in one embodiment, steps of providing a can body blank that has a sidewall that is of a substantially constant diameter; providing a mold unit that has at least one mold wall that defines a mold cavity conforming a desired final shape of the can body; positioning the can body blank within the mold cavity; and supplying a pressurized fluid into the mold cavity so that the can body blank is forced by pressure against the mold wall, causing the can body blank to assume the desired final shape of the can body. Axial compression is preferably applied to the can body blank in order to reduce internal stresses during molding of the container. A second embodiment includes steps of radially deforming the can body blank in selected areas by selected amounts to achieve an intermediate can body that is radially modified, but is still symmetrical about its axis; and superimposing a preselected pattern of mechanical deformations that have an axial component onto the intermediate can body. Related apparatus and processes are also disclosed.

59 Claims, 7 Drawing Sheets

U.S. PATENT DOCUMENTS

| | | | |
|---|---|---|---|
| 5,261,261 | 11/1993 | Ramsey | 72/105 |
| 5,261,558 | 11/1993 | Claydon | 220/671 |
| 5,326,250 | 7/1994 | Doudement | 425/541 |
| 5,334,007 | 8/1994 | Denis et al. | 425/526 |
| 5,338,181 | 8/1994 | Denis et al. | 425/526 |
| 5,342,558 | 8/1994 | Denis et al. | 264/25 |
| 5,622,070 | 4/1997 | Bulso, Jr. | 72/68 |

FOREIGN PATENT DOCUMENTS

| | | |
|---|---|---|
| 613946-1 | 11/1985 | Japan . |
| 724416 | 2/1988 | Japan . |
| 63052721 | 3/1988 | Japan . |
| 727797 | 3/1988 | Japan . |
| 724416-1 | 11/1988 | Japan . |
| 748958 | 11/1988 | Japan . |
| 613946 | 12/1993 | Japan . |
| 907967 | 10/1994 | Japan . |
| 07124656 | 5/1995 | Japan . |
| 7-165224 | 6/1995 | Japan . |
| 932536 | 8/1995 | Japan . |
| 971981 | 1/1997 | Japan . |
| 388 887 | 6/1965 | Switzerland . |
| 1570820 A1 | 6/1990 | U.S.S.R. . |
| 1755992A1 | 8/1992 | U.S.S.R. . |
| 216 704 | 6/1924 | United Kingdom . |
| 1 279 421 | 6/1972 | United Kingdom . |
| 1 309 695 | 3/1973 | United Kingdom . |
| 2 003 416 | 8/1979 | United Kingdom . |
| 2 123 329 | 2/1984 | United Kingdom . |
| 2120148 | 7/1985 | United Kingdom . |
| 2 224 965 | 4/1990 | United Kingdom . |
| 2 257 073 | 1/1993 | United Kingdom . |
| 2 266 290 | 10/1993 | United Kingdom . |
| WO 83/01916 | 6/1983 | WIPO . |
| WO 92/13653 | 8/1992 | WIPO . |
| WO 95/08410 | 3/1995 | WIPO . |
| WO 95/15227 | 6/1995 | WIPO . |

SYSTEMS AND METHODS FOR MAKING DECORATIVE SHAPED METAL CANS

BACKGROUND OF THE INVENTION

1. Field of the Invention

This invention relates generally to the field of consumer packaging, and more specifically to metal cans, such as the steel and aluminum cans that are commonly used for packaging soft drinks, other beverages, food and aerosol products.

2. Description of the Prior Art and Recent Technology

Metal cans for soft drinks, other beverages and other materials are of course in wide use in North America and throughout the world. The assignee of this invention, Crown Cork & Seal Company of Philadelphia, is the world's largest designer and manufacturer of such cans.

The art of making and packing metal cans is constantly evolving in response to improved technology, new materials, and improved manufacturing techniques. Other forces driving the evolution of technology in this area include raw material prices, the nature of new materials to be packaged and the marketing goals of the large companies that manufacture and distribute consumer products such as soft drinks.

Interest has existed for some time for a metal container that is shaped differently than the standard cylindrical can in such a distinctive way to become part of the product's trade dress, or to be otherwise indicative of the source or the nature of the product. To the inventors best knowledge, however, no one has yet developed a practical technique for manufacturing such an irregularly shaped can at the volume and speed that would be required to actually introduce such a product into the marketplace.

U.S. Pat. No. 3,224,239 to Hansson, which dates from the mid 1960's, discloses a system and process for using pneumatic pressure to reshape cans. This process utilized a piston to force compressed air into a can that is positioned within a mold. The compressed air caused the can wall to flow plastically until it assumed the shape of the mold.

Technology such as that disclosed in the Hansson patent has never, to the knowledge of the inventors, been employed with any success for the reshaping of drawn and wall ironed cans. One reason for this is that the stress that is developed in the wall of the can as it is being deformed can lead to defects that are potentially failure-inducing, e.g., localized thinning, splitting or cracking. The risk of thinning can be reduced by increasing the wall thickness of the can, but this would make shaped cans so produced prohibitively expensive. The risk of splitting and cracking can be reduced by a process such as annealing, but at the expense of reduced toughness and abuse resistance of the final product.

A need exists for an improved apparatus and process for manufacturing a shaped metal can design, that is effective, efficient and inexpensive, especially when compared to technology that has been heretofore developed for such purposes, and that reduces the tendency of a shaped can to fail as a result of thinning, splitting or cracking.

SUMMARY OF THE INVENTION

Accordingly, it is an object of the invention to provide an improved apparatus and process for manufacturing a shaped metal can that is effective, efficient and inexpensive, especially when compared to technology that has been heretofore developed for such purposes, and that provides insurance against internal stresses within the can that could cause thinning, splitting or cracking.

In order to achieve the above and other objects of the invention, a method of manufacturing a metallic can body that is shaped distinctively in order to enhance its visual presentation to consumers, includes, according to a first aspect of the invention, steps of: (a) providing a can body blank; (b) providing a mold unit that has at least one mold wall that defines a mold cavity conforming to a desired final shape of the can body the mold unit being constructed of more than one part, at least one of the parts being movable toward another in a direction that is substantially parallel to an axis of the can body blank during operation, the mold wall including inwardly extending portions and outwardly extending portions; (c) positioning the can body blank within the mold cavity so as to precompress the can body blank with the inwardly extending portions of the mold wall; (d) supplying a pressurized fluid into the mold cavity so that the can body blank is forced by pressure against the mold wall, causing the can body blank to assume the desired final shape of the can body, the precompression that is performed in step (c) minimizing the amount of outward deformation that is required to achieve the final shape of the can body; and (e) substantially simultaneously with step (d), moving at least one of the mold parts toward another in the axial direction.

According to a second aspect of the invention, a method of manufacturing a metallic can body that is shaped distinctively in order to enhance its visual presentation to consumers, includes steps of: (a) making a can body blank; (b) at least partially annealing at least a portion of the can body blank, thereby giving the annealed portion of the can body blank increased ductility; (c) providing a mold unit that has at least one mold wall that defines a mold cavity conforming to a desired final shape of the can body, the mold unit being constructed of more than one part, at least one of the parts being movable toward another in a direction that is substantially parallel to an axis of the can body blank during operation; (d) positioning the can body blank within the mold cavity; (e) supplying a pressurized fluid into the mold cavity so that the can body blank is forced by pressure against the mold wall, causing the can body blank to assume the desired final shape of the can body; and (f) substantially simultaneously with step (e), moving at least one of the mold parts toward another in the axial direction.

According to a third aspect of the invention, an apparatus for manufacturing a metallic can body that is shaped distinctively in order to enhance its visual presentation to consumers includes structure for making a can body blank; molding structure comprising a mold unit that has at least one mold wall that defines a mold cavity conforming a desired final shape of the can body, said mold wall comprising inwardly extending portions and outwardly extending portions, the mold unit being constructed of more than one part, at least one of the parts being movable toward another in a direction that is substantially parallel to an axis of the can body blank during operation; positioning structure for positioning the can body blank within the mold cavity so as to precompress the can body blank by the inwardly extending portions of the mold wall; fluid supply structure for supplying a pressurized fluid into the mold cavity so that the can body blank is forced by pressure against the mold wall, causing the can body blank to assume the desired final shape of the can body, the precompression minimizing the amount of outward deformation that is required to achieve the final shape of the can body; and axial reduction structure for moving at least one of the mold parts toward another in the axial direction.

According to a fourth aspect of the invention, an apparatus for manufacturing a metallic can body that is shaped distinctively in order to enhance its visual presentation to consumers includes structure for making a can body blank; structure for at least partially annealing at least a portion of the can body blank, thereby giving the annealed portion of the can body blank increased ductility; mold structure comprising a mold unit that has at least one mold wall that defines a mold cavity conforming to a desired final shape of the can body, the mold unit being constructed of more than one part, at least one of the parts being movable toward another in a direction that is substantially parallel to an axis of the can body blank during operation; positioning structure for positioning the can body blank within the mold cavity; fluid supply structure for supplying a pressurized fluid into the mold cavity so that the can body blank is forced by pressure against the mold wall, causing the can body blank to assume the desired final shape of the can body; and axial reduction structure for moving at least one of the mold parts toward another in the axial direction.

These and various other advantages and features of novelty which characterize the invention are pointed out with particularity in the claims annexed hereto and forming a part hereof However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
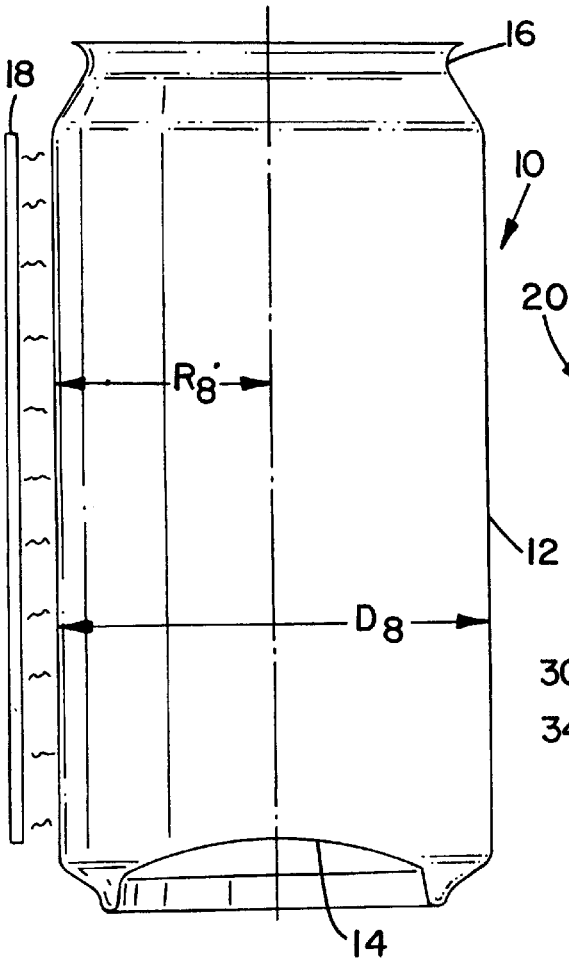
FIG. 1 is a cross-sectional view taken through a can body blank or preform that is constructed according to a preferred embodiment of the invention.
Figure 2:
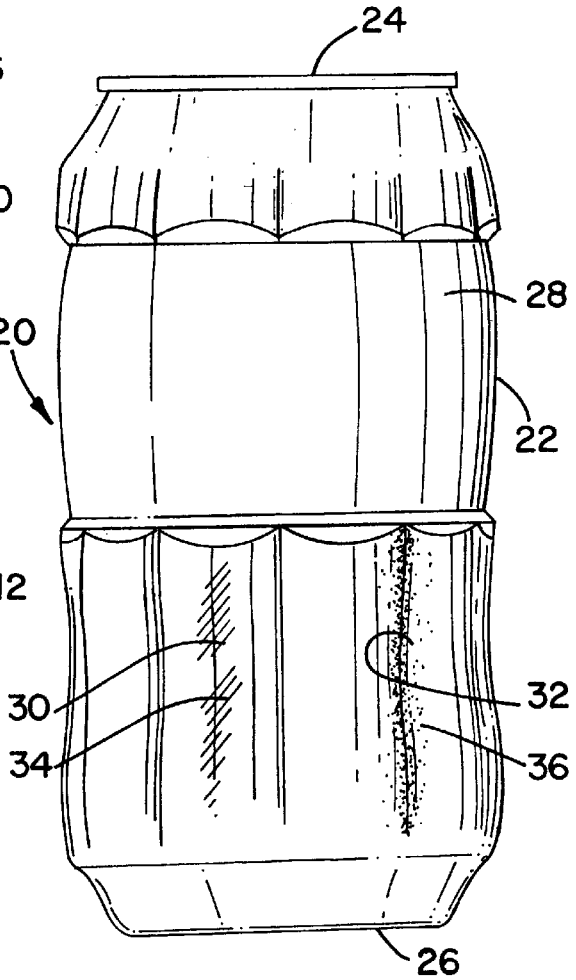
FIG. 2 is a side elevational view of a shaped can body according to a preferred embodiment of the invention.

Referring now to the drawings, wherein like reference numerals designate corresponding structure throughout the views, and referring in particular to FIGS. 1 and 2, a can body blank or preform 10 according to a preferred embodiment of the invention is the body of a two-piece can, which is preferably formed by the well-known drawing and ironing process. Can body blank 10 includes a substantially cylindrical sidewall surface 12, a bottom 14, and necked upper portion 16. Alternatively, the upper portion of cylindrical sidewall 12 could be straight.

As is well known in this area of technology, the can body blank 10 must be washed after the drawing and ironing process, and then must be dried prior to being sent to the decorator. The drying process typically is performed at a temperature of about 250 degrees Fahrenheit (which is about 121 degrees Celsius). According to one aspect of this invention, the drying is performed at a higher temperature than is ordinary to partially anneal at least selected portions of the can body blank 10. In FIG. 1, a heat source 18 is schematically depicted, which is preferably part of the dryer assembly, but could be at any point in the apparatus prior to the molding unit. As will be discussed in greater detail below, can body blank 10 is preferably formed of aluminum and the partial annealing is preferably accomplished at a temperature that is substantially within the range of about 375 degrees Fahrenheit (about 190.5 degrees Celsius) to about 550 degrees Fahrenheit (about 288 degrees Celsius), with a more preferred range of about 450 degrees Fahrenheit (about 232 degrees Celsius) to about 500 degrees Fahrenheit (about 260 degrees Celsius), and a most preferred temperature of about 475 degrees Fahrenheit (about 246 degrees Celsius). This is in contrast to true annealing, which would be at temperatures over 650 degrees Fahrenheit (about 353 degrees Celsius). The purpose of the partial annealing is to give the can body blank 10 enough ductility to be formed into a shaped can 20, such as is shown in FIG. 2 of the drawings, but greater toughness than would be possible if the can body blank were fully annealed.

Alternatively, the partial annealing could be performed in an oven such as the lacquer or decorator oven, rather than in the dryer.

Alternatively, can body blank 10 could be fabricated from steel instead of aluminum. In this case, the preferred temperature range for partial annealing would be substantially within the range of 1112 degrees Fahrenheit (600 degrees Celsius) to about 1472 degrees Fahrenheit (800 degrees Celsius). More preferably, the partial annealing would be performed at approximately 1382 degrees Fahrenheit (750 degrees Celsius).

Referring now to FIG. 2, shaped can 20 is decorated and shaped distinctively in order to enhance its visual presentation to consumers. As may be seen in FIG. 2, can body 20 includes a bottom 26, a shaped sidewall 22 that is shaped to substantially deviate from the standard cylindrical can body shape, such as the shape of can body blank 10. The shaped sidewall 22 includes areas, such as ribs 30 and grooves 32, where accentuation of such deviations from the cylindrical shape might be desired. According to one important aspect of the invention, decoration is provided on the external surface of the shaped sidewall 22 in a manner that will accentuate those areas of the sidewall where accentuation of the deviation from the cylindrical shape is desired. As may be seen in FIG. 2, a first type of decoration, which may be a lighter color, is provided on the rib 30, while a second type of decoration 36, which may be a darker color, is provided within at least one of the grooves 32. By providing such selective decoration, and by properly registering the decoration to the deviations in the shaped sidewall 22, a synergistic visual effect can be obtained that would be impossible to obtain alone by shaping the can or by decorating the can.

Referring again to FIG. 2, shaped sidewall 22 also has a flat area 28, where writing or a label might be applied, and is closed by a can end 24, which is applied in the traditional double seaming process.

According to the preferred method, after the partial annealing by the heat source 18 at the drying station, can body blank 10 will be transported to a decorator, where the distinctive decoration will be applied while the can body blank 10 is still in its cylindrical configuration. Markers might also be applied during the decorating process that can be used for registration of the decoration to the mold contours during subsequent forming steps, which will be described in greater detail below.

Figure 3:
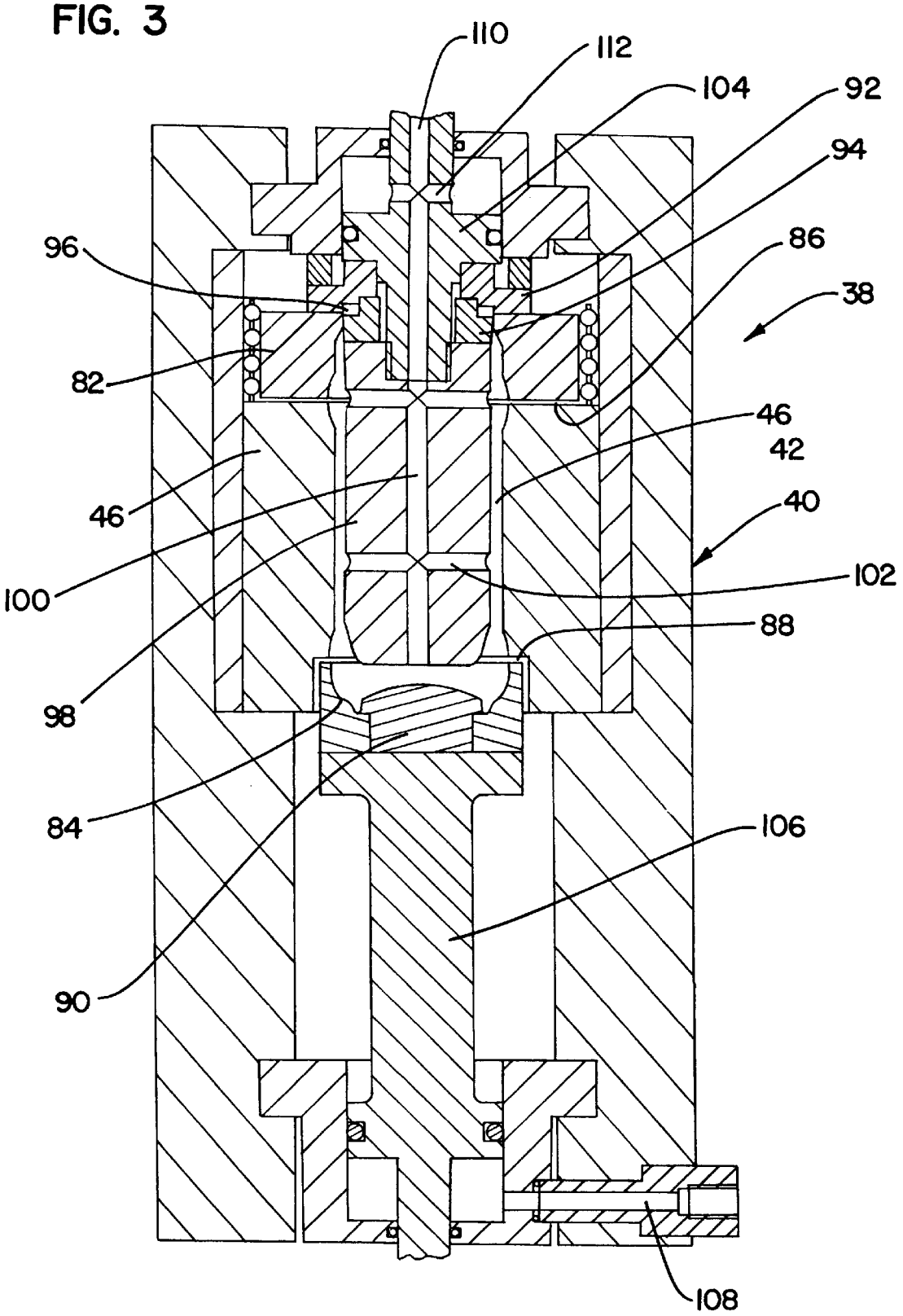
FIG. 3 is a diagrammatical view of An apparatus for making a shaped can body according to a preferred embodiment of the invention.

Referring now to FIG. 3, An apparatus 38 is depicted which, according to the preferred embodiment of the invention, is provided to manufacture a shaped can 20 of the type that is depicted in FIG. 2. As may be seen in FIGS. 3, 4 and 5, apparatus 38 includes a mold 40 having a mold wall 46 that defines a mold cavity 42 conforming to the desired final shape of the shaped can body 20. As is shown diagrammatically in FIG. 7, the mold 40 is of the split wall type and the mold wall 46 will include inwardly extending portions 48 that are less in diameter than the diameter $D_b$ of the cylindrical sidewall 12 of the can body blank 10 depicted by the dotted lines in FIG. 7*b*. The mold wall 46 will also include a number of outwardly extending portions that are greater in diameter than the diameter $D_b$ of the sidewall 12 of the can body blank 10. In other words, the inwardly extending portions 48 tend to compress the cylindrical sidewall 12 of the can body blank 10 to the position 12' shown by the solid lines in FIG. 7*b*, while the sidewall 12 of the can body blank 10 must be expanded to conform to the outwardly extending portions 50 of the mold wall 46. Preferably, the perimeter of the cylindrical sidewall remains a constant length when compressed in this manner so the perimeter of the cylindrical compressed sidewall 12' is the same length as the circumference of the sidewall 12 of the can body blank 10.

As is best shown in FIG. 3, the mold unit 40 has three die parts 82, 46 and 84 which comprise neck ring, mold side wall and base support, respectively. The die parts are separated from each other by gaps or "split lines" 86 and 88. For ease of machining, the base support die 84 is made in two parts, with a central part 90 supporting the base dome of the can body. The neck ring 82 provides simple support to the necked portion of the can body. These components together define the chamber or mold cavity 42 to receive the can body and are machined to the desired final shape of the can body after blow forming. Vent holes 49 are provided (see FIGS. 4 and 5) to allow trapped air to escape during forming.

A pair of seal and support rings 92, 94 and a rubber sealing ring 96 are provided to seal the top edge of the container body. A space saving mandrel 98 passes through the center of the seal and support rings 92, 94, 96 to a position just above the base support dome 84. The mandrel 98 supplies air to the cavity of a can body within the cavity 42 via a central bore 100 and radial passages 102. The apparatus further includes an upper piston and a lower piston 104, 106 which together apply a load to both ends of the can in the mould cavity 42. Lower piston 106 is moveable upwards by structure of a pressurized air supply which is fed to the piston via passage 108. Similarly, the upper piston is moveable downwards by structure of a pressurized air supply which is fed to the piston via passages 110 and 112. In the preferred embodiment shown, the passage 110 is connected to the central bore 100 of the mandrel 98 so that the upper piston and can cavity share a common air supply. The common air supply is split for the piston 104 and cavity at the junction of the air passage 112 and the central mandrel bore 100, within the piston 104 so as to minimize losses and to maintain the same pressure supplied to the cavity and piston. Preferably, means are provided to control the flow rate of air supplied to each piston and the cavity. Cavity pressure and piston pressure can therefore be closely controlled.

Figure 6:
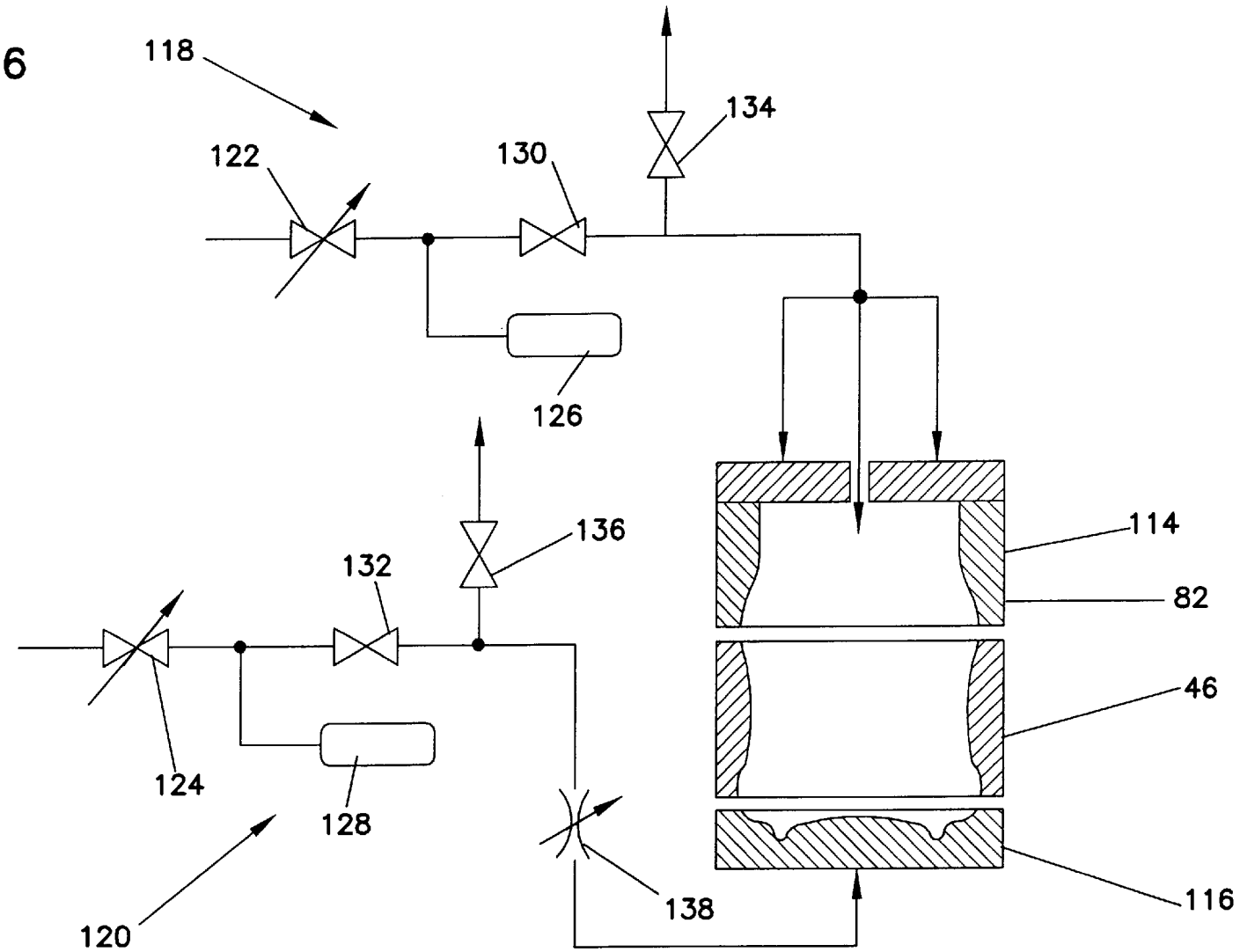
FIG. 6 is a schematic diagram depicting a pressure supply apparatus for the mold unit depicted in FIG. 3.

A schematic circuit diagram which shows how air is supplied to the pistons and can cavity is shown in FIG. 6. In the figure, the upper piston 104 and seal and support rings 92,94 are shown schematically as a single unit 114. Likewise, the base support 84,90 and lower piston 106 are shown as a single unit 116. Units 114 and 116 and neck ring 82 are movable, whereas the side wall die 46 of the mold is shown fixed.

The circuit comprises two pressure supplies. Pressure supply 118 supplies pressurised air to the top piston 104 and cavity of the can within the mold cavity 42. Pressure supply 120 supplies pressurised air to the lower piston 106 only.

The two supplies each comprise pressure regulators 122, 124, reservoirs 126,128, blow valves 130,132 and exhaust valves 134,136. In addition, the lower pressure supply 120 includes a flow regulator 138. Optionally, the upper pressure supply 118 may also include a flow regulator, although it is not considered essential to be able to adjust the flow in both supplies. Reservoirs 126, 128 prevent a high drop in supply pressure during the process.

Typically, high pressure air of around 30 bar is introduced to the can cavity and to drive the top of the can. The air pressure to drive the bottom piston 106 is typically around 50 bar, depending on the piston area. The air pressure within the mold cavity 42 provides the force which is required to expand the can body blank outwards but also applies an unwanted force to the neck and base of the can which leads to longitudinal tension in the can side wall. The two pistons are thus used to drive the top and the bottom of the can, providing a force which counteracts this tension in the can side wall.

The pressure of the air supplied to the pistons is critical in avoiding failure of the can during forming due to either splitting or wrinkling. Splitting will occur if the tension in the can side wall is not sufficiently counteracted by the piston pressure, since the pressure in the pistons is too low. Conversely, the pressure of the air supplied should not be so high that this will lead to the formation of ripples in the side wall.

For this reason, preferably no stops are required to limit the stroke of the pistons. If the stroke were limited, the can might not be fully expanded against the mould wall before the pistons reached the stops. If this occurs, the tension in the can side wall would cease to be balanced by the piston pressure with a consequent risk of splitting. In effect, the contact of the expanded can with the side wall of the mould prevents further movement of the pistons.

It should be noted therefore that the balance between the can cavity pressure and the piston pressure is preferably maintained at all times throughout the forming cycle so that the rate of pressure rise in the cavity and behind the pistons should be balanced throughout the cycle, particularly when the can wall yields. The rate of pressure rise can be controlled by the flow regulator 138 or by adjusting the supply pressure via the pressure regulators 122,124.

By adjusting the can cavity pressure versus the pressure that is applied to move the mold elements 82, 46, 84 towards one another, the apparatus may be operated in one of three different ways. By minimizing application of pressure to the outer mold parts 82,84, the apparatus may be operated so as to simply move the mold parts toward another without exerting any force on the can body. This will reduce the gaps 86, 88 in the mold unit 40 as the can body shrinks longitudinally during the expansion process, and will reduce but not necessarily neutralize axial tensile stress created in the sidewall of the can body during expansion. Alternatively, by providing increased pressure to drive the outer mold parts toward one another, a slight longitudinal or axial force is applied to the can body which is substantially equal to the axial tensile stress in the can body sidewall, thus balancing such stress and protecting the can body from consequential weakening and possible splitting. A third mode of operation would be to provide an even greater pressure to drive the outer mold parts toward one another in order to apply an axially compressive force to the can body that would be greater than what would be necessary to cancel the tensile stress in the sidewall during operation. A net compressive force is believed to be preferable provided that such a force does not lead to the formation of wrinkles.

In order to form the can, the blow valves 130,132 are first opened. It is possible to have a short delay between the opening times of the blow valves if required to obtain a better match between the piston and cavity pressures but there will then need to be a higher rate of pressure rise for one circuit in order to maintain this balance. A delay can also be used to compensate for different pipe lengths, maintaining a pressure balance at the time of forming. The upper supply 118 is split for the piston 104 and cavity as close as possible to the piston 104 as described above in reference to FIG. 3.

The apparatus is designed so that, at the latest, when each piston reaches its maximum travel the can is fully reshaped and the gaps 86, 88 are not closed up at the end. Closing of the gaps can lead to splitting of the can due to excessive tension in the side wall in the same way as does limiting movement of the pistons before full expansion has occurred. However, the final gap should not be excessive since any witness mark on the side wall becomes too apparent, although removal of sharp edges at the split lines alleviates this problem.

Once the shaping operation is completed, the air is exhausted via valves 134 and 136. Clearly the exhaust valves are closed throughout the actual forming process. It is important that both supplies are vented simultaneously since the compressive force applied by the pistons to balance the cavity pressure (longitudinal tension) may be greater than the axial strength of the can so that uneven exhausting leads to collapse of the can.

Figure 4:
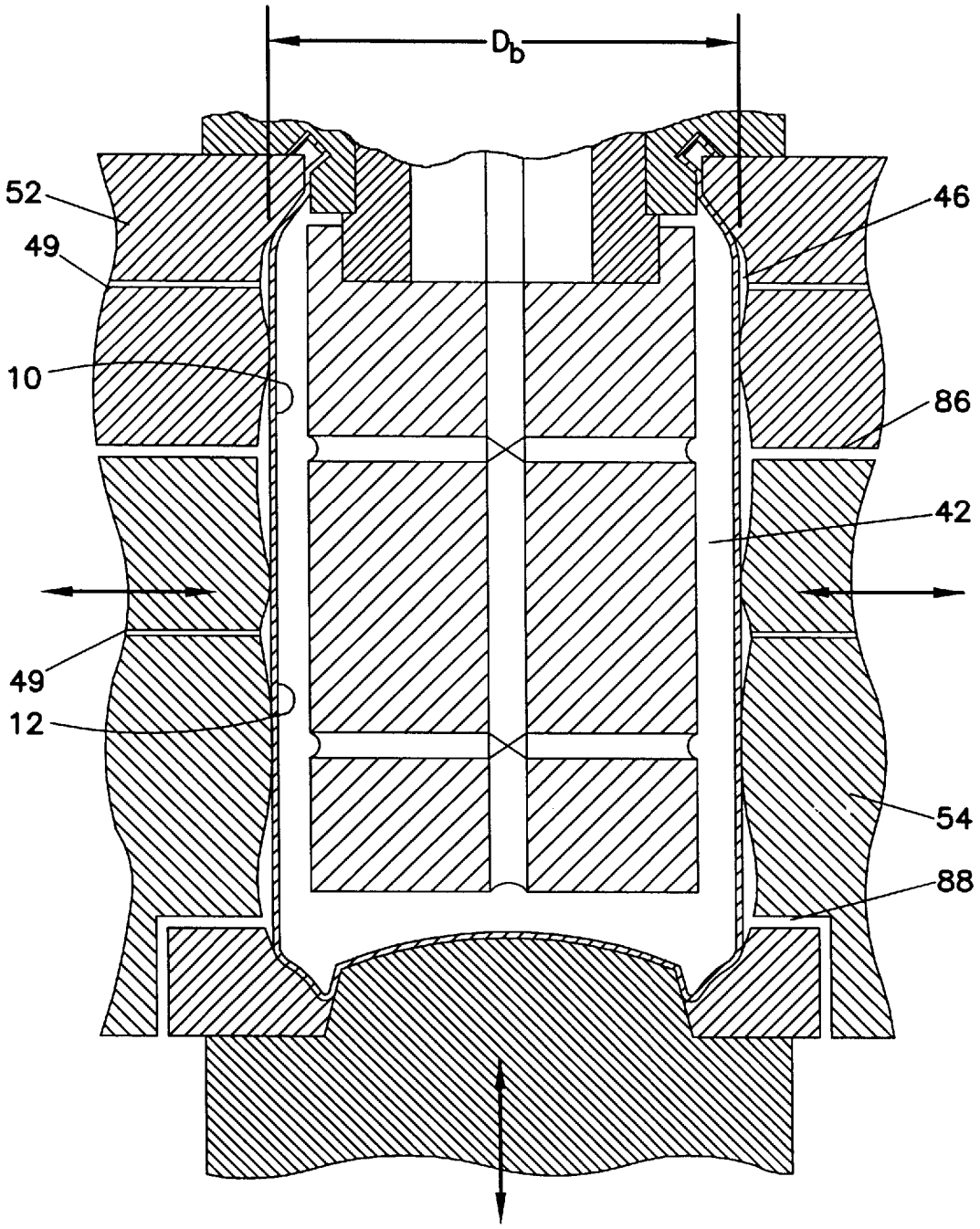
FIG. 4 is a fragmentary cross-sectional view through a mold unit in the apparatus depicted in FIG. 3, shown in a first condition.

As may best be seen in FIG. 4, the can body blank 10 is preferably positioned within the mold cavity 42 and its interior space is sealed into communication with a source of pressurized fluid, as described above. As may be seen in FIG. 4, the cavity 42 is designed so as to impart a slight compression to the can body blank 10 as it is inserted therein. This is preferably accomplished by forming the mold assembly elements into halves 52, 54, shown in FIG. 4 that are split so as to be closeable about the can body blank prior to pneumatic expansion of the can body blank 10.

Figure 7A:
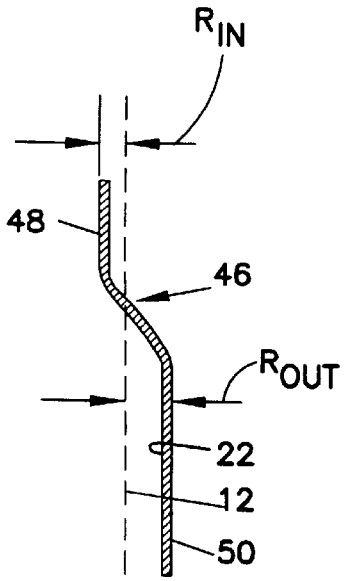
FIG. 7 is diagrammatical depiction of a precompression step that is performed in the apparatus as depicted in FIG. 3.
Figure 7B:
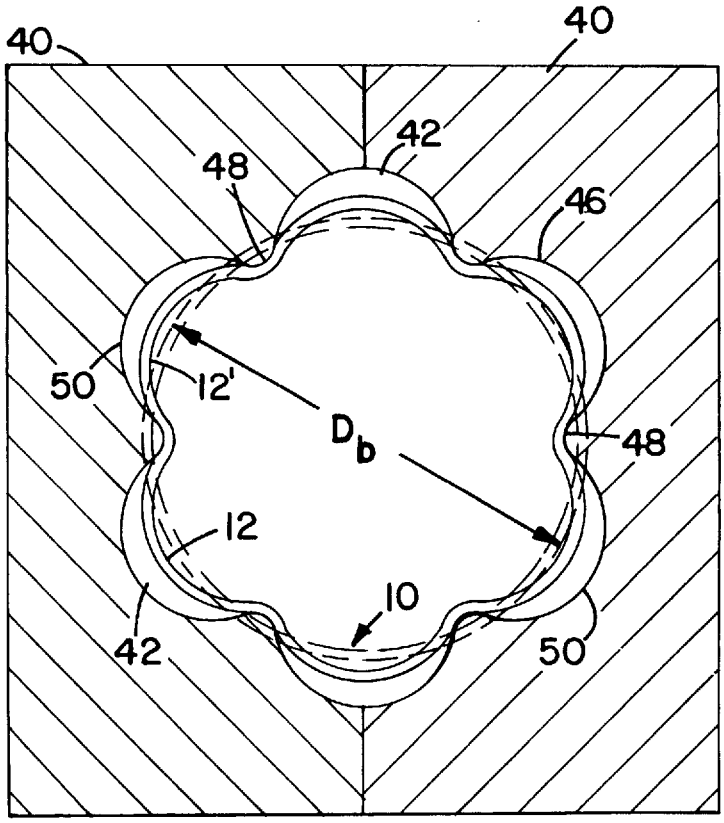

As the mold halves 52, 54 close about the cylindrical sidewall 12, the inwardly extending portions 48 of the mold wall 46 thus compress or precompress the cylindrical sidewall 12 by distances up to the amount $R_{in}$, shown in FIG. 7. After the mold has been closed and sealed and pressurized fluid is supplied into the mold cavity 46 so as to force the can body blank 10 against the mold wall 46, can body blank 10 will be forced to assume the desired final shape of the shaped can 20. The state of the shaped sidewall 22 is shown after the step in FIG. 5. In this step, the cylindrical sidewall 12 of the can body blank 10 is expanded up to an amount $R_{out}$, again shown diagrammatically in FIG. 7.

Preferably, the precompression that is effected by the closing of the mold halves 52, 54 is performed to deflect the sidewall 12 of the can body blank 10 radially inwardly by a distance of $R_{in}$ that is within the range of about 0.1 to about 1.5 millimeters. More preferably, this distance $R_{in}$ is within the range of 0.5 to about 0.75 millimeters. The distance $R_{out}$ by which cylindrical sidewall 12 is radially expanded outwardly to form the outermost portions of the shaped sidewall 22 is preferably within the range of about 0.1 to about 5.0 millimeters. A most preferable range for distance $R_{out}$ is about 0.5 to 3.0 millimeters. Most preferably, $R_{out}$ is about 2 millimeters.

To understand the benefit that is obtained by the precompression of the cylindrical sidewall 12 prior to the expansion step, it must be understood that a certain amount of annealing or partial annealing may be useful, particularly in the case of aluminum can bodies, to obtain the necessary ductility for the expansion step. However, the more complete the annealing, the less strong and tough the shaped can 20 will ultimately be. By using the precompression to get a significant portion of the differential between the innermost and outermost portions of the pattern that is superimposed onto the final shaped can 20, the amount of actual radial expansion necessary to achieve the desired pattern is reduced. Accordingly, the amount of annealing that needs to be applied to the can body blank 10 is also reduced. The precompression step, then, allows the desired pattern to be superimposed on the shaped can 20 with a minimum of annealing and resultant strength loss, thus permitting the cylindrical sidewall 12 of the can body blank 10 to be formed as thinly as possible for this type of process.

As one embodiment of the invention, the mold wall may be formed of a porous material so as to allow air trapped between the sidewall of the can body blank and the mold wall to escape during operation, although vent holes will probably still be required. One such material is porous steel, which is commercially available from AGA in Leydig, Sweden.

Figure 5:
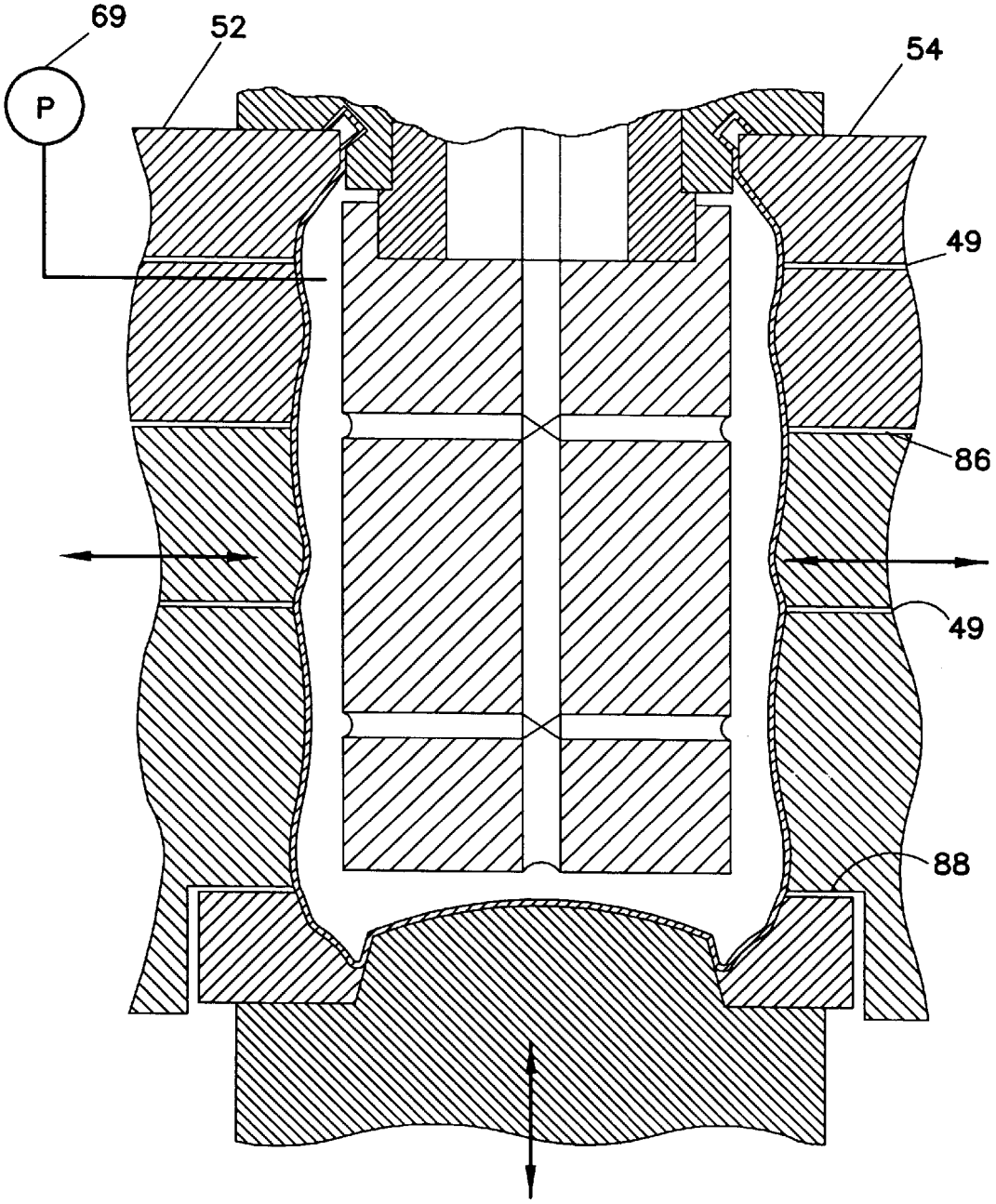
FIG. 5 is a fragmentary cross-sectional view through a mold unit in the apparatus depicted in FIG. 3, shown in a second condition.

For purposes of quality monitoring and control, fluid pressure within the mold cavity 46 is monitored during and after the expansion process by structure of a pressure monitor 69, shown schematically in FIG. 5. Pressure monitor 69 is of conventional construction. If the can body develops a leak during the expansion process, or if irregularities in the upper flange or neck of the can creates a bad seal with the gas probe, pressure within the mold cavity will drop much faster in the mold chamber 46 than would otherwise be the case. Pressure monitor 69 will sense this, and will indicate to an operator that the can body might be flawed.

In the case of steel cans, pressure within the mold chamber could be made high enough to form the can body into, for example, a beading-type pattern wherein a number of circumferential ribs are formed on the container.

Figure 8:
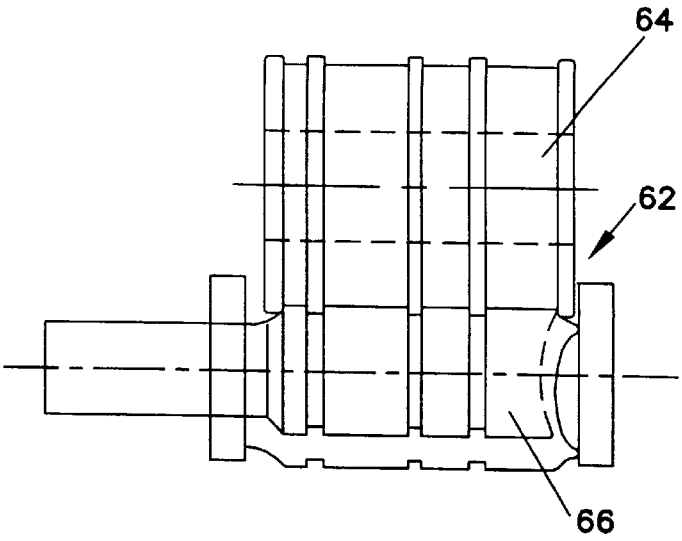
FIG. 8 is a diagrammatical depiction of a beading step in a method that is performed according to a second embodiment of the invention.
Figure 9:
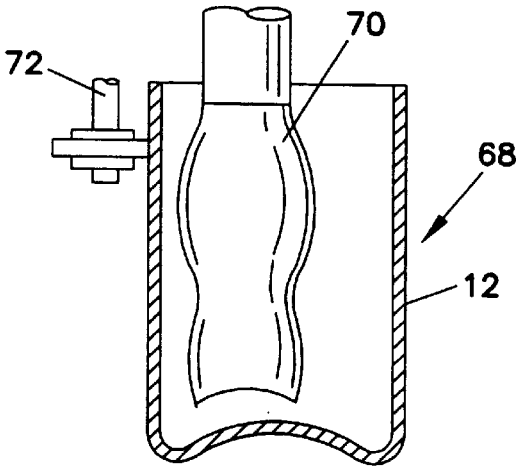
FIG. 9 is a diagrammatical depiction of a spinning step in a method that is performed according to a second embodiment of the invention.
Figure 10:
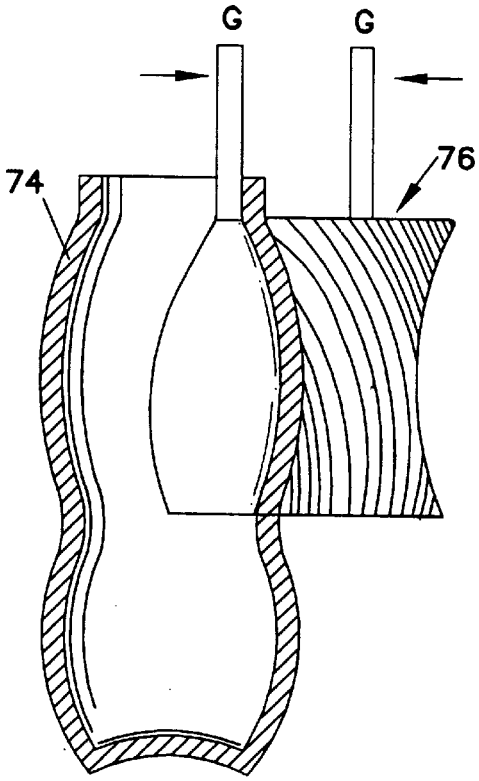
FIG. 10 is a diagrammatical depiction of a knurling step that can be performed as a second step in either the second or third embodiments of the invention referred to above.

A second method and apparatus for manufacturing a metallic can body that is shaped distinctively in order to enhance its visual presentation to consumers is disclosed in FIGS. 7 and 9 of the drawings. A third embodiment is depicted in FIGS. 8 and 9 of the drawings. According to both the second and third embodiments, a distinctively shaped metallic can body is manufactured by providing a can body blank, such as the can body blank 10 shown in FIG. 1, that has a sidewall 12 of substantially constant diameter, then radially deforming the can body blank 10 in selective areas by selected amounts to achieve an intermediate can body 74 that is radially modified, but is still symmetrical about its access, and then superimposing a preselected pattern of mechanical deformations onto the intermediate can body 74. Describing now the second embodiment of the invention, a beading apparatus 62 of the type that is well known in this area of technology includes an anvil 66 and a beading tool 64. A beading apparatus 62 is used to radially deform the can body blank 10 into the radially modified intermediate can body 74 shown in FIG. 9. The intermediate can body 74, as may be seen in FIG. 9, has no deformations thereon that have an axial component, and is substantially cylindrical about the access of the can body 74. A knurling tool 76 is then used to superimpose the preselected pattern of mechanical deformations, in this case ribs and grooves, onto the intermediate can body, making it possible to produce a shaped can 20 of the type that is shown in FIG. 2.

In the third embodiment, shown in FIGS. 8 and 9, a spinning unit 68 is used to deform the cylindrical sidewall 12 of the can body blank 10 radially into the intermediate can body 74. Spinning unit 68 includes, as is well known in the technology, a mandrel 70 and a shaping roller 72 that is opposed to the mandrel 70. After this process, the knurling step shown in FIG. 9 is preferably performed on the so formed intermediate can body 74 in a manner that is identical to that described above.

Alternatively to the knurling step shown in FIG. 9, the intermediate can body 74 produced by either the method shown in FIG. 7 or that shown in FIG. 8 could, alternatively, be placed in a pneumatic expansion die or mold unit 40 of the type that is shown in FIGS. 3–5. Intermediate can body 74 would then be expanded in a manner that is identical to that described above in order to achieve the shaped can 20.

In the second and third methods described above, the can body blank 10 is also preferably partially annealed by the heat source 18 during the drying process, but, preferably, to a lesser extent than that in the first described embodiment. Preferably, the annealing for the second and third methods described above is performed at a temperature that is within the range of about 375 degrees Fahrenheit (about 190 degrees Celsius) to about 425 degrees Fahrenheit (about 218 degrees Celsius). The methods described with reference to FIGS. 7 and 8 thus require less annealing than that described with respect to the previous embodiment, meaning that a stronger shaped can 20 is possible at a given weight or wall thickness, or that the weight of the shaped can 20 can be reduced with respect to that produced by the first described method. Disadvantages of the second and third methods, however, include more machinery and greater mechanical complexity, as well as more wear and tear on the cans, spoilage and possible decoration damage as a result of the additional mechanical processing and handling. It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed. Alternatively, for example, can body blank 10 could be formed by alternative processes, such as a draw-redraw process, a draw-thin-redraw process, or by a three-piece welded or cemented manufacturing process.

What is claimed is:

1. A method of manufacturing a metallic can body that is shaped distinctively in order to enhance its visual presentation to consumers, comprising steps of:

(a) providing a can body blank;

(b) providing a mold unit that has at least one mold wall that defines a mold cavity conforming to a desired final shape of the can body, said mold unit being constructed of more than one part, at least one of said parts being movable toward another in a direction that is substantially parallel to an axis of the can body blank during operation, said mold wall comprising radially inwardly extending portions and radially outwardly extending portions;

(c) positioning said can body blank within said mold cavity so as to precompress the can body blank with the radially inwardly extending portions of said mold wall;

(d) supplying a pressurized fluid into said mold cavity so that said can body blank is forced by pressure against said mold wall, causing said can body blank to assume the desired final shape of the can body, said precompression that is performed in step (c) minimizing the amount of outward deformation that is required to achieve the final shape of the can body; and (e) substantially simultaneously with step (d), moving at least one of said mold parts toward another in the axial direction.

2. A method according to claim 1, wherein said can body blank comprises aluminum, and further comprising the step of:

at least partially annealing said can body blank prior to step (c) to give the can body blank enough ductility to be worked into the desired shape, and whereby the precompression in step (c) that reduces that amount of outward expansion necessary to achieve the desired position also reduces the degree of annealing that is necessary to permit such expansion, thereby preserving as much strength and toughness as possible.

3. A method according to claim 2, wherein said partial annealing step is performed at a temperature that is within the range of about 375 degrees Fahrenheit (190.5° C.) to about 550 degrees Fahrenheit (288° C.).

4. A method according to claim 1, wherein said precompression in step (c) is performed to deflect said sidewall of said can body blank radially inwardly by a distance that is within the range of about 0.1 to about 1.5 millimeters.

5. A method according to claim 1, wherein said introduction of fluid in step (d) is performed to deflect said sidewall of said can body blank radially outwardly by a distance that is within the range of about 0.1 to about 5.0 millimeters.

6. A method according to claim 1, where the inward deflection of said sidewall in step (c) is approximately one third the outward deflection that takes place in step (d).

7. A method according to claim 1, wherein the mold unit comprises three parts, and wherein step (e) comprises moving at least two of the three parts towards the third from a first position in which the parts are spaced from each other by gaps which open into the mold cavity to a second position in which the gaps between the mold parts are reduced in size whilst still opening into the mold cavity.

8. A method according to claim 7, wherein step (e) further comprises positioning the gaps at the points of maximum expansion of the can body blank.

9. A method according to claim 1, wherein step (e) comprises applying an axial force to the can body blank that is sufficient to exert a net compressive force on the sidewall of the can body blank during step (d).

10. A method according to claim 1, further comprising balancing the force exerted by the pressurized fluid in step (d) with an axial force that is applied in step (e).

11. A method according to claim 1, wherein said can body blank has a sidewall that is of substantially constant diameter.

12. A method of blow molding a metallic can body that is shaped distinctively in order to enhance its visual presentation to consumers, comprising steps of:

(a) making a can body blank;

(b) partially annealing the whole of the can body blank, thereby giving the annealed can body blank increased ductility;

(c) providing a mold unit that has at least one mold wall that defines a mold cavity conforming to a desired final shape of the can body, said mold unit being constructed of more than one part, at least one of said parts being movable toward another in a direction that is substantially parallel to an axis of the can body blank during operation;

(d) positioning said can body blank within said mold cavity;

(e) supplying pressurized air into said mold cavity so that said can body blank is forced by air pressure against said mold wall, causing said can body blank to assume the desired final shape of the can body; and (f) substantially simultaneously with step (e), moving at least one of said mold parts toward another in the axial direction.

13. A method according to claim 12, wherein said partial annealing step is performed at a temperature that is within the range of about 375 degrees Fahrenheit (190.5° C.) to about 550 degrees Fahrenheit (288° C.).

14. A method according to claim 13, wherein said partial annealing step is performed at a temperature that is within the range of about 450 degrees Fahrenheit (232° C.) to about 500 degrees Fahrenheit (260° C.).

15. A method according to claim 14, wherein said partial annealing step is performed at a temperature that is about 475 degrees Fahrenheit (246° C.).

16. A method according to claim 12, wherein the mold unit comprises three parts, and wherein step (f) comprises moving at least two of the three parts towards the third from a first position in which the parts are spaced from each other by gaps which open into the mold cavity to a second position in which the gaps between the mold parts are reduced in size whilst still opening into the mold cavity.

17. A method according to claim 16, wherein step (f) further comprises positioning the gaps at the points of maximum expansion of the can body blank.

18. A method according to claim 12, wherein the force exerted by the pressurized fluid in step (e) is balanced with an axial force that is applied in step (f).

19. A method according to claim 12, wherein step (f) comprises applying an axial force to the can body blank that is sufficient to exert a net compressive force on the sidewall of the can body blank during step (e).

20. A method according to claim 12, wherein said can body blank has a sidewall that is of substantially constant diameter.

21. A method according to claim 12, wherein step (b) is performed during lacquering or decorating said can body blank.

22. A method according to claim 12, wherein step (b) is performed during drying of said can body blank.

23. A method according to claim 12, further comprising the steps of:

(a) washing the can body blank after the making thereof; and (b) drying said washed can body blank, the step of drying said can body blank and the step of partially annealing the whole of said can body blank being performed simultaneously.

24. A method according to claim 23, wherein the steps of simultaneously drying and partially annealing the whole of the can body blank comprises directing the washed can body blank to a dryer.

25. A method according to claim 12, wherein said forcing of said can body blank against said mold wall creates axial tension in said can body blank, and wherein the motion of said mold part imparts an axial load to said can body blank that reduces said axial tension.

26. A method according to claim 25, wherein said motion of said mold part imparts an axial load to said can body blank that cancels said axial tension.

27. A method according to claim 12, wherein said can body blank is made of aluminum, and wherein the whole of the can body blank is partially annealed at a temperature in the range of about 375° F. to 550° F.

28. A method according to claim 12, wherein said can body blank is made of steel, and wherein the whole of the can body blank is partially annealed at a temperature in the range of about 600° C. to 800° C.

29. An apparatus for manufacturing a metallic can body that is shaped distinctively in order to enhance its visual presentation to consumers, comprising:

means for making a can body blank;

molding means comprising a mold unit that has at least one mold wall that defines a mold cavity conforming to a desired final shape of the can body, said mold wall comprising radially inwardly extending portions and radially outwardly extending portions, said mold unit being constructed of more than one part, at least one of said parts being movable toward another in a direction that is substantially parallel to an axis of the can body blank during operation;

positioning means for positioning said can body blank within said mold cavity so as to precompress said can body blank with said radially inwardly extending portions of said mold wall;

fluid supply means for supplying a pressurized fluid into said mold cavity so that said can body blank is forced by pressure against said mold wall, causing said can body blank to assume the desired final shape of the can body, said precompression minimizing the amount of outward deformation that is required to achieve the final shape of the can body; and axial reduction means for moving at least one of said mold parts toward another in the axial direction.

30. An apparatus according to claim 29, wherein said molding means is constructed to deflect said sidewall of said can body blank radially inwardly by a distance that is within the range of about 0.1 to about 1.5 millimeters.

31. An apparatus according to claim 29, wherein said molding means is constructed to deflect said sidewall of said can body blank radially outwardly by a distance that is within the range of about 0.1 to about 5.0 millimeters.

32. An apparatus according to claim 29, where said molding means is constructed to deflect said sidewall approximately one third the outward deflection that takes place during pressurization.

33. An apparatus according to claim 29, wherein said axial reduction means comprises said molding means having three parts defining said mold cavity and means for moving at least two of said three parts towards the third from a first position in which the parts are spaced from each other by gaps which open into the mold cavity to a second position in which the gaps between the mold parts are reduced in size whilst still opening into the mold chamber.

34. An apparatus according to claim 33, in which the gaps in the mould are positioned at the points of maximum expansion of the container.

35. An apparatus according to claim 29, wherein said axial reduction means comprises applying an axial force to the can body blank that is sufficient to exert a net compressive force on the sidewall of the can body blank during expansion.

36. An apparatus according to claim 29, wherein said axial reduction means is constructed and arranged to balance a force exerted on the container body blank by said fluid supply means.

37. An apparatus according to claim 29, further comprising a single pressurized fluid line for supplying both said fluid supply means and said axial compression means.

38. An apparatus for blow molding a metallic can body that is shaped distinctively in order to enhance its visual presentation to consumers, comprising:

means for making a can body blank;

means for partially annealing the whole of the can body blank thereby giving the annealed can body blank increased ductility;

mold means comprising a mold unit that has at least one mold wall that defines a mold cavity conforming to a desired final shape of the can body, said mold unit being constructed of more than one part, at least one of said parts being movable toward another in a direction that is substantially parallel to an axis of the can body blank during operation;

positioning means for positioning said can body blank within said mold cavity;

air supply means for supplying pressurized air into said mold cavity so that said can body blank is forced by pressure against said mold wall, causing said can body blank to assume the desired final shape of the can body; and axial reduction means for moving said at least one of said mold parts toward another in the axial direction.

39. An apparatus according to claim 38, wherein said partial annealing step is performed by said drying means at a temperature that is within the range of about 375 degrees Fahrenheit (190.5° C.) to about 550 degrees Fahrenheit (288° C.).

40. An apparatus according to claim 39, wherein said partial annealing step is performed by said drying means at a temperature that is within the range of about 450 degrees Fahrenheit (232° C.) to about 500 degrees Fahrenheit (260° C.).

41. An apparatus according to claim 40, wherein said partial annealing step is performed by said drying means at a temperature that is about 475 degrees Fahrenheit (246° C.).

42. An apparatus according to claim 38, wherein said axial reduction means comprises said molding means having three parts defining said mold cavity and means for moving at least two of said three parts towards the third from a first position in which the parts are spaced from each other by gaps which open into the mold cavity to a second position in which the gaps between the mold parts are reduced in size whilst still opening into the mold chamber.

43. An apparatus according to claim 42, in which the gaps in the mould are positioned at the points of maximum expansion of the container.

44. An apparatus according to claim 38, wherein said axial reduction means comprises applying an axial force to the can body blank that is sufficient to exert a net compressive force on the sidewall of the can body blank during expansion.

45. An apparatus according to claim 38, wherein said axial reduction means is constructed and arranged to balance a force exerted on the container body blank by said fluid supply means.

46. An apparatus according to claim 38, further comprising a single pressurized fluid line for supplying both said fluid supply means and said axial compression means.

47. An apparatus according to claim 38, wherein said means for partially annealing comprises a lacquer or decorator oven.

48. An apparatus according to claim 38, wherein said means for partially annealing comprises a can body dryer.

49. An apparatus according to claim 38, wherein said means for partially annealing the whole of said can body blank comprises means for drying said can body blank.

50. An apparatus according to claim 38, wherein said forcing of said can body blank against said mold wall creates axial tension in said can body blank, and wherein said axial reduction means has means for imparting an axial load to said can body blank that reduces said axial tension.

51. An apparatus according to claim 38, wherein said can body blank is made of aluminum, and wherein said means for partially annealing the whole of said can body blank comprises means for partially annealing at a temperature in the range of about 375° F. to 550° F.

52. An apparatus according to claim 38, wherein said can body blank is made of steel, and wherein said means for partially annealing the whole of said can body blank comprises means for partially annealing at a temperature in the range of about 600° C. to 800° C.

53. A method of blow molding a metallic can body blank into a distinctively shaped can in order to enhance its visual presentation to consumers, comprising steps of:

(a) forming a can body blank;

(b) partially annealing at least a portion of said can body blank, thereby giving said annealed portion of said can body blank increased ductility;

(c) placing said can body blank into a mold having an internal cavity, said mold cavity formed by an inner surface defining a shape that generally conforms to said desired distinctive can shape, said mold being formed from a plurality of mold parts each of which forms a portion of said mold cavity inner surface, at least one of said mold parts being movable toward an other of said mold parts in the axial direction;

(d) introducing pressurized air into said can body blank so as to radially expand at least a portion of said can body blank against said mold cavity inner surface, whereby said can body blank assumes said distinctive can shape; and (e) moving at least one of said mold parts toward another of said mold parts in the axial direction during said radial expansion of said can body blank, said mold part being moved so that it does not axially compress said can body blank.

54. A method according to claim 53, wherein the partial annealing step comprises partially annealing the whole of said can body blank.

55. A method according to claim 53, wherein the step of moving at least one of said mold parts comprises moving said mold part so as to apply a compressive axial load to said can body blank during said radial expansion thereof, said compressive axial load reducing but not eliminating said axial tension.

56. A method according to claim 53, further comprising the step of forming said can body blank by a drawing and ironing process, said can body blank having a neck portion, a sidewall portion, and a base portion.

57. A method of blow molding a metallic can body blank into a distinctively shaped can in order to enhance its visual presentation to consumers, comprising steps of:

(a) forming a can body blank;

(b) partially annealing at least a portion of said can body blank, thereby giving said annealed portion of said can body blank increased ductility;

(c) placing said can body blank into a mold having an internal cavity, said mold cavity formed by an inner surface defining a shape that generally conforms to said desired distinctive can shape, said mold being formed from a plurality of mold parts each of which forms a portion of said inner surface, at least one of said parts being movable toward another in a direction that is substantially parallel to the axis of the can body blank;

(d) introducing pressurized air into said mold cavity so as to radially expand at least a portion of said can body blank against said mold inner surface, whereby said can body blank assumes said distinctive can shape, said radial expansion of said can body blank creating axial tension therein;

(e) moving at least one of said mold parts toward another of said mold parts in the axial direction during said radial expansion of said can body blank; and (f) applying an axial load to said can body blank during said radial expansion that reduces said axial tension without compressing said can body blank.

58. A method according to claim 57, wherein said axial load is sufficient to substantially cancel said tension in said can body blank created by said radial expansion.

59. An apparatus for blow molding a metallic can body blank into a distinctively shaped can in order to enhance its visual presentation to consumers, comprising:

(a) means for forming a can body blank;

(b) means for partially annealing at least a portion of said can body blank, thereby giving said annealed portion of said can body blank increased ductility;

(c) a mold having an internal cavity for containing said can body blank, said mold cavity formed by an inner surface defining a shape that generally conforms to said desired distinctive can shape, said mold being formed from a plurality of mold parts each of which forms a portion of said inner surface, at least one of said parts being movable toward another in a direction that is substantially parallel to the axis of the can body blank;

(d) means for introducing pressurized air into said mold cavity so as to radially expand at least a portion of said can body blank against said mold inner surface, whereby said can body blank assumes said distinctive can shape, said radial expansion of said can body blank creating axial tension therein;

(e) means for moving at least one of said mold parts toward another of said mold parts in the axial direction during said radial expansion of said can body blank; and (f) means for applying an axial load to said can body blank during said radial expansion that reduces said axial tension without compressing said can body blank.

* * * * *

UNITED STATES PATENT AND TRADEMARK OFFICE

CERTIFICATE OF CORRECTION

PATENT NO. : 5,832,766

DATED : November 10, 1998

INVENTOR(S) : Mark W. Hartman et al.

It is certified that error appears in the above-indentified patent and that said Letters Patent is hereby corrected as shown below:

On the title page item 56

Page 1, Column 1, Beneath " References Cited U.S PATENT DOCUMENTS", insert

| | | | |
|---|---|---|---|
| "5,214,948 | 6/1993 | Sanders et al. | 72/58" |
| "4,827,747 | 5/1989 | Okada et al. | 72/59" |
| "4,414,834 | 11/1983 | Gratzer et al. | 72/58" |
| "4,289,007 | 9/1981 | Kraft | 72/58" |
| "3,335,590 | 8/1967 | Early | 72/58" |
| "2,980,993 | 4/1961 | Lyoti | 72/370" |
| "3,040,684 | 6/1962 | Hillgren | 72/58" |
| "2,083,943 | 6/1937 | Clifford | 72/62" |
| "840,091 | 1/1907 | Schumacher et al. | 72/58" |

Page 1, Column 2, Beneath "FOREIGN PATENT DOCUMENTS", insert

| | | |
|---|---|---|
| "64-2733 | 1/1989 | JP" |
| "62-199232 | 9/1987 | JP" |
| "61-255725 | 11/1986 | JP" |

Page 2, Column 1, Line 16., delete " 12/1993" and insert --12/1983-- therefor.

Column 3, Line 22, delete "hereof However, for" and insert -- hereof. However, for-- therefor.

Column 3, Line 36, delete "view of An apparatus" and insert --view of an apparatus-- therefor.

UNITED STATES PATENT AND TRADEMARK OFFICE

CERTIFICATE OF CORRECTION

PATENT NO. : 5,832,76

DATED : November 10,1998

INVENTOR(S) : Mark W. Hartman et al.

It is certified that error appears in the above-identified patent and that said Letters Patent is hereby corrected as shown below:

Column 5, Line 12, delete "now to Fig. 3, An apparatus " and insert --now to Fig. 3, an apparatus-- therefor.

Signed and Sealed this

Twenty-fifth Day of May, 1999

*Attest:*

*Attesting Officer*

Q. TODD DICKINSON

*Acting Commissioner of Patents and Trademarks*